US005384625A

United States Patent [19]

Anayama et al.

[11] Patent Number: 5,384,625

[45] Date of Patent: Jan. 24, 1995

[54] IMAGE FORMING METHOD

[75] Inventors: Hideki Anayama, Yokohama; Toshiyuki Yoshihara, Kawasaki; Hideyuki Ainoya; Hidetoshi Hirano, both of Tokyo, all of Japan

[73] Assignee: Canon Kabushiki Kaisha, Tokyo, Japan

[21] Appl. No.: 171,409

[22] Filed: Dec. 22, 1993

[30] Foreign Application Priority Data

Dec. 28, 1992 [JP] Japan ..... 4-358742

[51] Int. Cl.[6] ..... G03G 5/06; G03G 5/04

[52] U.S. Cl. ..... 355/211; 430/58

[58] Field of Search ..... 355/211, 200; 430/58, 430/78, 56, 59

[56] References Cited

U.S. PATENT DOCUMENTS

| | | | |
|---|---|---|---|
| 4,444,861 | 4/1984 | Nogami et al. | 430/58 |
| 4,664,997 | 5/1987 | Suzuki et al. | 430/58 |
| 4,728,592 | 3/1988 | Ohaku et al. | 430/59 |
| 5,194,354 | 3/1993 | Takai et al. | 355/200 X |
| 5,246,807 | 9/1993 | Kanemaru et al. | 355/211 X |
| 5,298,353 | 3/1994 | Ohmori | 355/211 X |

FOREIGN PATENT DOCUMENTS

| | | |
|---|---|---|
| 409737 | 1/1991 | European Pat. Off. . |
| 482884 | 4/1992 | European Pat. Off. . |
| 57-148745 | 9/1982 | Japan . |
| 59-31965 | 2/1984 | Japan . |
| 59-36254 | 2/1984 | Japan . |
| 59-44054 | 3/1984 | Japan . |
| 59-49544 | 3/1984 | Japan . |
| 59-166959 | 9/1984 | Japan . |
| 61-239248 | 10/1986 | Japan . |
| 62-67094 | 3/1987 | Japan . |
| 63-0366 | 1/1988 | Japan . |
| 63-116158 | 5/1988 | Japan . |
| 63-198067 | 8/1988 | Japan . |
| 64-17066 | 1/1989 | Japan . |
| 4-170549 | 6/1992 | Japan . |

OTHER PUBLICATIONS

Patent Abstracts of Japan, vol. 13, No. 64 (P-827), Feb. 14, 1989 of JPA 63-250657.

Data Base WP1, Section Ch, Week 9135, Derwent Publ., AN 91-256360 of JPA 3-166548.

*Primary Examiner*—R. L. Moses

*Attorney, Agent, or Firm*—Fitzpatrick, Cella, Harper & Scinto

[57] ABSTRACT

An image forming process is carried out through the steps of electrostatically charging a cylindrical electrophotographic photosensitive member, forming an electrostatic latent image by image exposure, developing the latent image and transferring the developed image to a transfer member. The photosensitive member is comprised of a conductive support and a photosensitive layer which contains oxytitanium phthalocyanine as a charge-generating material and a charge-transporting material. The charge-generating material and the charge-transporting material have a work function ($W_F^{CG}$) and a work function ($W_F^{CT}$), respectively. Those work functions satisfies the following relationship:

$$-0.2 < W_F^{CG} - W_F^{CT} \leqq 0 \text{ (eV)}$$

The above steps is carried out while the photosensitive member rotates once at 1.5 seconds or less.

4 Claims, 1 Drawing Sheet

FIGURE
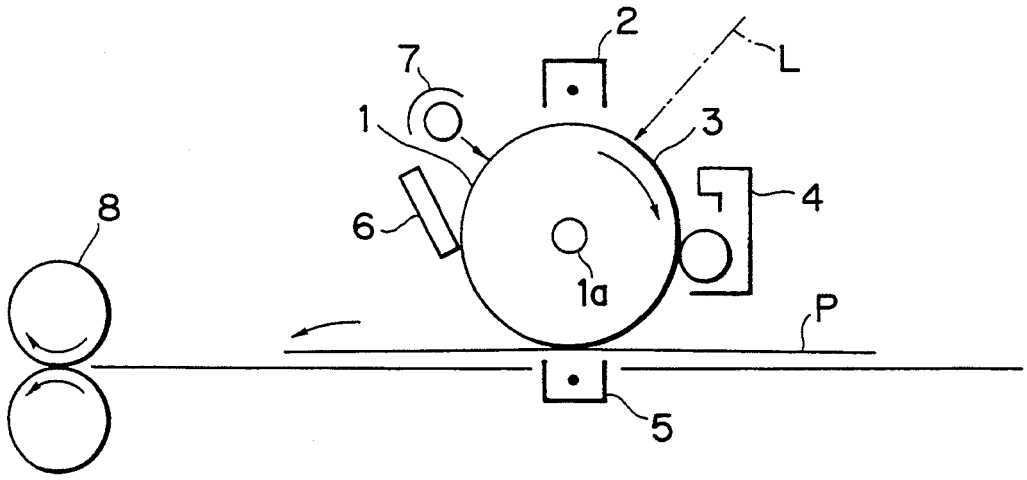

IMAGE FORMING METHOD

BACKGROUND OF THE INVENTION

1. Field of the Invention

This invention relates to an image forming method, and more particularly to an image forming method carried out using in a high-speed process an electrophotographic photosensitive member containing a specific material.

2. Related Background Art

Electrophotographic photosensitive members using organic photoconductive materials have such advantages that they have a very high productivity; as compared with ones using inorganic materials, material design can be readily made so that sensitivity regions can be controlled with ease; and they can be relatively inexpensive. Thus, they have been studied in a wide range. In particular, most electrophotographic photosensitive members having a charge generation layer containing what is called a charge-generating material such as an organic photoconductive dye or pigment and a charge transport layer containing a charge-transporting material exhibit good performances also in respect of sensitivity and durability (running performance) that have been considered disadvantageous in conventional electrophotographic photosensitive members, and have been put into practical use.

In recent years, among charge-generating materials, oxytitanium phthalocyanine (hereinafter also "TiOPc") has attracted notice. The TiOPc has a very high sensitivity to light with a long wavelength of around 600 to 800 nm, and hence is very useful as a charge-generating material used in electrophotographic photosensitive members for electrophotographic printers or digital copying machines using LED or semiconductor laser as light sources.

Meanwhile, electrophotographic apparatus are sought to be made to have a higher image quality, a higher speed and a higher running performance.

However, although the electrophotographic photosensitive members employing TiOPc have a high sensitivity, they have caused fog, black lines, uneven density and so forth in the images obtained when used in a high-speed process.

SUMMARY OF THE INVENTION

An object of the present invention is to provide an image forming method by which good images can be stably obtained even when carried out at a high speed.

The present invention provides an image forming method carried out by a process comprising the steps of;

electrostatically charging a cylindrical electrophotographic photosensitive member to impart electric charges thereto; said electrophotographic photosensitive member comprising a conductive support and a photosensitive layer provided thereon, wherein said photosensitive layer contains oxytitanium phthalocyanine as a charge-generating material and a charge-transporting material, and the charge-generating material and the charge-transporting material have a work function ($W_F^{CG}$) and a work function ($W_F^{CT}$), respectively, that satisfy the expression:

$$-0.2 < W_F^{CG} - W_F^{CT} \leqq 0 \ (EV);$$

subjecting the electrophotographic photosensitive member to image exposure to form thereon an electrostatic latent image;

developing the electrostatic latent image to form a visible image; and transferring the visible image to a transfer member;

said steps of electrostatic charging, image exposure, developing and transfer being carried out while said electrophotographic photosensitive member rotates once, and the time taken for said electrophotographic photosensitive member to rotate once being 1.5 seconds or less.

BRIEF DESCRIPTION OF THE DRAWING

FIGURE schematically illustrates the construction of an electrophotographic apparatus in which the image forming method of the present invention is employed.

DESCRIPTION OF THE PREFERRED EMBODIMENTS

The electrophotographic photosensitive member used in the present invention comprises a cylindrical conductive support and a photosensitive layer provided thereon. The photosensitive layer contains oxytitanium phthalocyanine (TiOPc) as a charge-generating material. As previously stated, faulty images such as images with fog, black lines or uneven density tend to occur when the electrophotographic photosensitive member containing TiOPc is used in a high-speed process. The reason therefor is unclear, but may be presumed as follows: because of a very high sensitivity of the TiOPc, photo-carriers are supposed to be generated in a very large quantity; hence, in a high-speed process, a subsequent electrophotographic process may be applied before the photo-carriers generated are well injected into, transported to and recombined with the charge-transporting material; in other words, while photo-carriers remain accumulated in the photosensitive layer; such residual carriers cause a memory to have an ill influence on images obtained. This more remarkably tends to occur as the charge-generating material has a higher sensitivity and the process cycle is shorter.

Now, the present inventors have discovered that the effect of the present invention, i.e., the high image quality, the high speed and the high running performance can be achieved when using an electrophotographic photosensitive member wherein the TiOPc and the charge-transporting material have a work function ($W_F^{CG}$) and a work function ($W_F^{CT}$), respectively, that satisfy the expression:

$$-0.2 < W_F^{CG} - W_F^{CT} \leqq 0 \ (eV),$$

in a high-speed process wherein the photosensitive member rotates once in 1.5 seconds or less.

If the value of $W_F^{CG} - W_F^{CT}$ is less than $-0.2$ eV, the present invention can not be well effective. If it is more than 0, the injection of photo-carriers may be excessively accelerated to make it impossible for the electrophotographic photosensitive member to well retain charges on its surface.

The work function referred to in the present invention can be measured using a surface analyzer Type AC-1 (a low-energy photoelectron measuring device), manufactured-by Riken Keiki K.K., where the surface of a sample is analyzed by measuring photoelectrons excited by ultraviolet rays in the atmosphere.

The photosensitive layer provided in the electrophotographic photosensitive member used in the present invention may be of either what is called a single layer type containing the charge-generating material and charge-transporting material in the same layer, or what is called a multilayer type having a charge generation layer containing the charge-generating material and a charge transport layer containing the charge-transporting material. In the present invention, it is preferred to use an electrophotographic photosensitive member having the conductive support, the charge generation layer and the charge transport layer in this order.

The charge generation layer can be formed by coating a solution prepared by dispersing the TiOPc in a suitable binder resin using a suitable solvent, followed by drying. It may preferably have a layer thickness of 5 μm or less, and particularly preferably from 0.1 to 2 μm.

The TiOPc used in the present invention is represented by the formula:

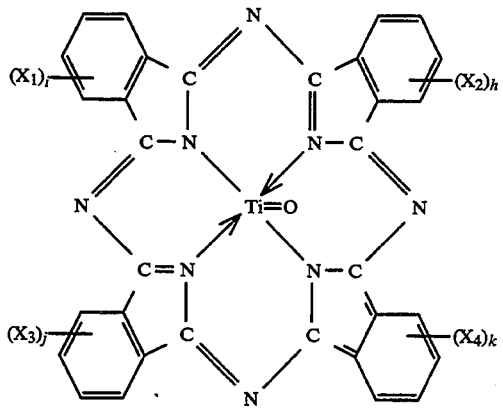

wherein $X_1$, $X_2$, $X_3$ and $X_4$ each represent Cl or Br, and h, i, j and k each represent an integer of 0 to 4.

Publications relating to synthesis methods and electrophotographic performance of the TiOPc can be exemplified by Japanese Patent Applications Laid-open No. 57-148745, No. 59-36254, No. 59-44054, No. 59-31965, No. 61-239248 and No. 62-67094. The TiOPc has various types of crystal form as in the case of other phthalocyanine compounds. For example, TiOPcs different in crystal form one another are reported in Japanese Patent Applications Laid-open No. 59-49544 (U.S. Pat. No. 4,444,861), No. 59-166959, No. 61-239248 (U.S. Pat. No. 4,728,592), No. 62-67094 (U.S. Pat. No. 4,664,997), No. 63-366, No. 63-116158, No. 63-198067 and No. 64-17066.

Of these, TiOPc with a crystal form having strong peaks at diffraction angles of $2\theta \pm 0.2°$ of 9.0°, 14.2°, 23.9° and 27.1° as measured by CuKα characteristic X-ray diffraction has a high sensitivity, and makes the present invention very effectively operate.

The work function of the TiOPc may differ depending on the crystal form, which shows a value of about 5.2 to 5.4 eV.

The charge transport layer can be formed by coating a solution prepared by dispersing the charge-transporting material in a suitable binder resin using a suitable solvent, followed by drying. Preferred examples of the charge-transporting material that can be used are shown below. Examples are by no means limited to the materials shown below, so long as it can satisfy the above relationship $-0.2 < W_F^{CG} - W_F^{CT} \leqq 0$ (eV). In the present invention, two or more kinds of charge-transporting material may be used so long as their mixture has a work function satisfying the above relationship. In this case, the work function may preferably be measured in a state where the charge-transporting materials are dispersed in resin.

(1)

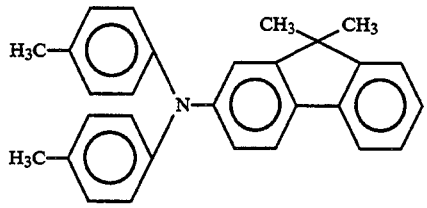

(2)

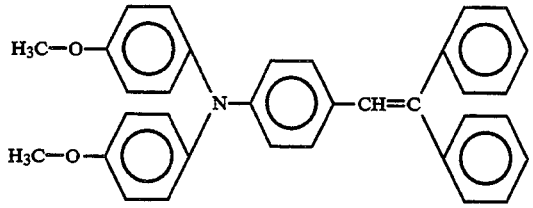

(3)

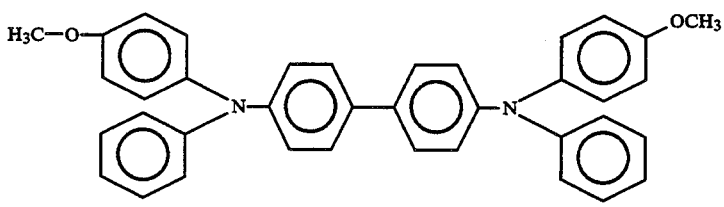

-continued (4)

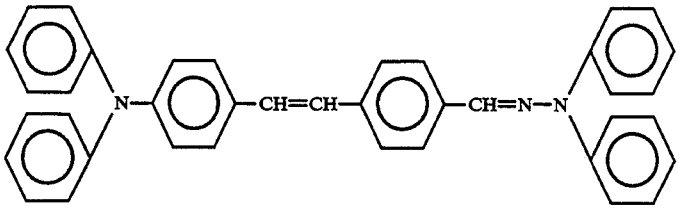

(5)

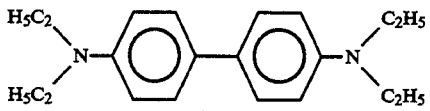

(6)

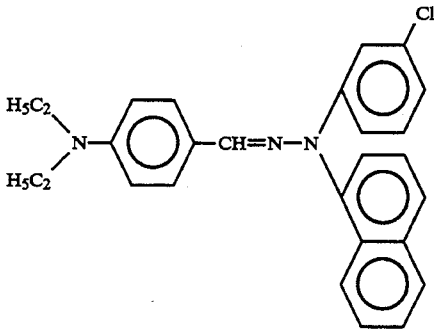

(7)

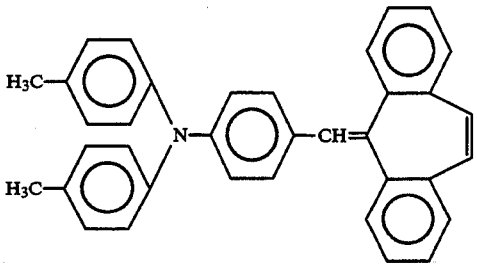

(8)

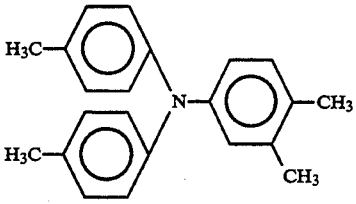

(9)

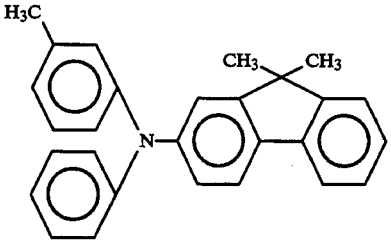

In the present invention, the relationship of $W_F^{CG} - W_F^{CT} \leqq -0.1$ is preferable.

In the present invention, the charge-transporting material and the binder resin may preferably be mixed in a proportion of from 5:10 to 20:10, and particularly preferably from 8:10 to 15:10, in weight ratio. Use of the charge-transporting material in an excessively small proportion may result in a low mobility to make the present invention less effective. On the other hand, use of the charge-transporting material in an excessively large proportion may result in an excessively low mechanical strength for a film of the charge transport layer.

The charge transport layer may preferably have a layer thickness of from 5 to 40 μm, and particularly preferably from 15 to 30 μm.

In the case when the photosensitive layer is of a single layer type, the same materials as the above may be used, and its thickness may preferably be from 5 to 40 μm, and particularly preferably from 15 to 30 μm.

The conductive support used in the present invention can be exemplified by those made of aluminum, an aluminum alloy, copper, zinc, stainless steel, vanadium, molybdenum, chromium, titanium, nickel, indium, gold and platinum. Besides, it is possible to use supports comprised of plastics (as exemplified by polyethylene, polypropylene, polyvinyl chloride, polyethylene terephthalate and acrylic resins) having a film formed by vacuum deposition of any of these metals or alloys, supports comprising any of the above plastics, metals or alloys covered with conductive particles (as exemplified by carbon black and silver particles) together with a suitable binder, and supports comprising plastics or paper impregnated with the conductive particles.

In the present invention, a subbing layer having a barrier function and an adhesion function may be provided between the conductive support and the photosensitive layer. The subbing layer can be formed using casein, polyvinyl alcohol, nitrocellulose, polyamides such as nylon 6, nylon 66, nylon 610, copolymer nylon and alkoxymethylated nylon, polyurethanes, aluminum oxide, etc. The subbing layer may preferably have a layer thickness of not more than 5 μm, preferably from 0.1 μm to 3 μm.

In the present invention, in order to protect the photosensitive layer from external mechanical and chemical ill influences, the photosensitive layer may also be provided thereon with a protective layer comprised of a resin layer or a resin layer containing conductive particles or a charge-transporting material.

The electrophotographic photosensitive member of the present invention can be not only used in electrophotographic copying machines, but also widely used in the fields to which electrophotography is applied, e.g., facsimile machines, laser beam printers, CRT printers, LED printers, liquid-crystal printers and laser lithography.

FIGURE schematically illustrates the construction of an electrophotographic apparatus in which the electrophotographic photosensitive member of the present invention is used.

In FIGURE, reference numeral 1 denotes a drum photosensitive member according to the present invention, which is rotated around a shaft 1*a* at a given peripheral speed in the direction shown by an arrow. In the course of rotation, the photosensitive member 1 is uniformly charged on its periphery, with positive or negative given potential by the operation of a charging means 2, and then photoimagewise exposed to light L (slit exposure, laser beam scanning exposure, etc.) at an exposure zone 3 by the operation of an imagewise exposure means (not shown). As a result, electrostatic latent images corresponding to the exposed images are successively formed on the periphery of the photosensitive member.

The electrostatic latent images thus formed are subsequently developed by toner by the operation of a developing means 4. The resulting toner-developed images are then successively transferred by the operation of a transfer means 5, to the surface of a transfer medium P fed from a paper feed section (not shown) between the photosensitive member 1 and the transfer means 5 synchronizing with the rotation of the photosensitive member 1.

The transfer medium P on which the images have been transferred is separated from the surface of the photosensitive member and led through an image-fixing means 8, where the images are fixed and then delivered to the outside as a transcript (a copy).

The surface of the photosensitive member 1 after the transfer of images is brought to removal of the toner remaining after the transfer, using a cleaning means 6. Thus the photosensitive member is cleaned on its surface. Further, the charges remaining thereon are eliminated by the operation of a pre-exposure means 7. The photosensitive member is then repeatedly used for the formation of images.

In the present invention, a device unit may be comprised of some of the components such as the above photosensitive member, charging means 2, developing means 4 and cleaning means 6, and this unit can be freely mounted on or detached from the body of the apparatus. For example, at least one of the charging means 2, the developing means 4 and the cleaning means 6 may be held into one device unit together with the photosensitive member so that the unit can be freely mounted or detached using a guide means such as rails fixed to the body of the apparatus.

In the case where the electrophotographic apparatus is used as a copying machine or a printer, the photosensitive member is exposed to photoimagewise exposing light L by irradiation with light reflected from, or transmitted through, an original, or is exposed to light while scanning a laser beam, driving an LED array or driving a liquid crystal shutter array according to signals into which the information read out from an original with a sensor is converted.

EXAMPLES

The present invention will be further described below by giving Examples.

Example 1

To an aluminum cylinder of 30 mm diameter and 260 mm long, a coating composition composed of the following materials was applied by dip coating, followed by heat curing at 140° C. for 30 minutes to form a conductive layer of 18 μm thick.

| | |
|---|---|
| Conductive pigment: tin oxide coated titanium oxide | 10 parts* |
| (*parts by weight; the same applies hereinafter) | |
| Resistance modifier pigment: titanium oxide | 10 parts |
| Binder resin: phenol resin | 10 parts |
| Leveling agent: silicone oil | 0.001 part |
| Solvent: methanol/methyl cellosolve in 1/1 weight ratio | 20 parts |

Next, a solution prepared by dissolving 3 parts of N-methoxymethylated nylon and 3 parts of copolymer nylon in a mixed solvent of 65 parts of methanol and 30 parts of n-butanol was applied to the surface of the conductive layer by dipping, followed by drying to from a subbing layer with a layer thickness of 0.5 μm.

Next, 3 parts of TiOPc crystal powder (having strong peaks at diffraction angles of $2\theta \pm 0.2°$ of 9.0°, 14.2°, 23.9° and 27.1° as measured by CuKα characteristic X-ray diffraction; $W_F^{CG}$: 5.3 eV), 2 parts of polyvinyl butyral resin and 80 parts of cyclohexanone were dispersed for 6 hours in a sand mill grinder making use of glass beads of 1 mm diameter. Thereafter, to the resulting dispersion, 100 parts of ethyl acetate was added to obtain a charge generation layer coating dispersion. This coating dispersion was applied to the surface of the subbing layer by dipping, followed by drying to form a charge generation layer with a thickness of 0.2 μm.

Next, 10 parts of a charge-transporting material comprising exemplary compound (1) ($W_F^{CT}$: 5.4 eV) and 10 parts of polycarbonate-Z resin were dissolved in a mixed solvent of 50 parts of monochlorobenzene and 10 parts of dichloromethane. The resulting coating composition was applied to the surface of the charge generation layer by dipping, followed by drying to form a charge transport layer with a layer thickness of 23 μm.

The photosensitive member thus obtained was tested on a latent image tester having the same constitution as an actual electrophotographic apparatus, to evaluate its potential stability. This tester was so designed as to be capable of arbitrarily setting the diameter of its photosensitive member and the process speed. In the present Example, the process speed was set at 72 mm/sec, that is, the time taken for the photosensitive member to rotate once was set at 1.3 seconds. The potential stability was evaluated in the following way: Initial dark portion potential Vd was set at −650 V and light portion potential Vl at −150 V, where the process of charging and exposure was repeatedly carried out 1,000 times, followed by measurement of each potential to determine the amount of changes in potential.

This photosensitive member was fitted to a laser beam printer LBP-NX, manufactured by Canon Inc., its process speed was set to the above value, and a 10,000 sheet continuous image reproduction running test was carried out. Images obtained were visually evaluated. The results are shown in Table 1.

Example 2

A photosensitive member was produced in the same manner as in Example 1 except that 9 parts of exemplary compound (1) and 1 part of exemplary compound (7) ($W_F^{CT}$: 5.45 eV) were used as the charge-transporting material. Evaluation was also made similarly. Here, the process speed was changed to 94 mm/sec (the time taken for the photosensitive member to rotate once: 1.0 second). Results obtained are shown in Table 1.

Example 3

A conductive layer and a subbing layer were formed in the same manner as in Example 1 except that an aluminum cylinder of 40 mm diameter and 260 mm long was used as the support.

Next, 3 parts of TiOPc crystal powder (having strong peaks at diffraction angles of $2\theta \pm 0.2°$ of 9.5°, 9.7°, 117°, 15.0°, 23.5°, 24.1° and 27.3° as measured by CuKα characteristic X-ray diffraction; $W_F^{CG}$: 5.2 eV), 2 parts of polyvinyl butyral resin and 80 parts of cyclohexanone were dispersed for 6 hours in a sand mill grinder making use of glass beads of 1 mm diameter. Thereafter, to the resulting dispersion, 100 parts of methyl ethyl ketone was added to obtain a charge generation layer coating dispersion. This coating dispersion was applied to the surface of the subbing layer by dipping, followed by drying to form a charge generation layer with a thickness of 0.2 μm.

Next, 10 parts of a charge-transporting material of exemplary compound (2) ($W_F^{CT}$: 5.35 eV) and 10 parts of polycarbonate-Z resin were dissolved in a mixed solvent of 50 parts of monochlorobenzene and 10 parts of dichloromethane. The resulting coating composition was applied to the surface of the charge generation layer by dipping, followed by drying to form a charge transport layer with a layer thickness of 25 μm.

Evaluation was made on the resulting photosensitive member in the same manner as in Example 1. Here, the process speed was changed to 90 mm/sec (the time taken for the photosensitive member to rotate once: 1.4 seconds) and also the photosensitive member had a different diameter. Hence, no continuous image reproduction running test was carried out. Results obtained are shown in Table 1.

Example 4

A photosensitive member was produced in the same manner as in Example 1 except that 12 parts of exemplary compound (3) ($W_F^{CT}$: 5.3 eV) was used as the charge-transporting material. Evaluation was also made similarly. Here, the process speed was changed to 120 mm/sec (the time taken for the photosensitive member to rotate once: 0.79 second). Results obtained are shown in Table 1.

Example 5

A photosensitive member was produced in the same manner as in Example 1 except that exemplary compound (4) ($W_F^{CT}$: 5.35 eV) was used as the charge-transporting material and the charge transport layer was formed in a layer thickness of 25 μm. Evaluation was also made similarly. Here, the process speed was changed to 67 mm/sec (the time taken for the photosensitive member to rotate once: 1.4 second). Results obtained are shown in Table 1.

Example 6

A photosensitive member was produced in the same manner as in Example 1 except that exemplary compound (8) ($W_F^{CT}$: 5.47 eV) was used as the charge-transporting material. Evaluation was also made similarly. Here, the process speed was changed to 63 mm/sec (the time taken for the photosensitive member to rotate once: 1.5 second). Results obtained are shown in Table 1.

Example 7

A photosensitive member was produced in the same manner as in Example 6 except that exemplary compound (9) ($W_F^{CT}$: 5.49 eV) was used as the charge-transporting material. Evaluation was also made similarly. Results obtained are shown in Table 1.

Comparative Example 1

A photosensitive member was produced in the same manner as in Example 6 except that comparative compound (A) represented by the formula shown below ($W_F^{CT}$: 5.55 eV) was used as the charge-transporting material. Evaluation was also made similarly.

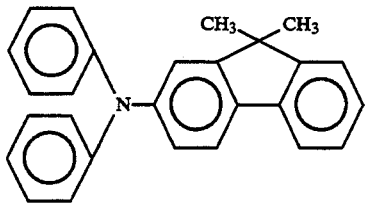

Results obtained are shown in Table 1.

Comparative Example 2

A photosensitive member was produced in the same manner as in Example 6 except that exemplary compound (1) and 6 parts of the charge-transporting material used in Comparative Example 1 ($W_F^{CT}$: 5.52 eV) were used as the charge-transporting material. Evaluation was also made similarly. Results obtained are shown in Table 1.

Experiment 1

An electrophotographic photosensitive member was produced in the same manner as in Example 1 except that the process speed was changed to 24 mm/sec (the time taken for the photosensitive member to rotate once: 3.9 second). Evaluation was also made similarly. Results obtained are shown in Table 1.

TABLE 1

| | Process speed (mm/sec) | Rotation* time (sec) | Charge-transporting material No. | $W_F^{CG}$ (eV) | $W_F^{CT}$ (eV) | $W_F^{CG}-W_F^{CT}$ (eV) | Potenttial variation (v) Dark p./light p. | Image evaluation |
|---|---|---|---|---|---|---|---|---|
| Example: | | | | | | | | |
| 1 | 72 | 1.3 | (1) | 5.3 | 5.4 | −0.1 | 10/10 | Excellent up to 10,000 sheets |
| 2 | 94 | 1.0 | (1)/(7) | 5.3 | 5.45 | −0.15 | 10/10 | Excellent up to 10,000 sheets |
| 3 | 90 | 1.4 | (2) | 5.2 | 5.35 | −0.15 | 15/10 | Excellent up to 10,000 sheets |
| 4 | 120 | 0.79 | (3) | 5.3 | 5.3 | 0 | 5/10 | Excellent up to 10,000 sheets |
| 5 | 67 | 1.4 | (4) | 5.3 | 5.35 | −0.05 | 10/5 | Excellent up to 10,000 sheets |
| 6 | 63 | 1.5 | (8) | 5.3 | 5.47 | −0.17 | 15/10 | Excellent up to 10,000 sheets |
| 7 | 63 | 1.5 | (9) | 5.3 | 5.49 | −0.19 | 15/15 | Excellent up to 10,000 sheets |
| Comparative Example: | | | | | | | | |
| 1 | 72 | 1.3 | (A) | 5.3 | 5.55 | −0.25 | 80/50 | Density uneveness on 1,000 sheets ff. |
| 2 | 72 | 1.3 | (1)/(A) | 5.3 | 5.52 | −0.22 | 70/50 | Density Uneveness on 2,000 sheets ff. |
| Experiment: | | | | | | | | |
| 1 | 24 | 3.9 | (1)/(A) | 5.3 | 5.52 | −0.22 | 15/15 | Excellent up to 10,000 sheets |

*Time taken for photosensitive member to rotate once

What is claimed is:

1. An image forming method carried out by a process comprising the steps of;

electrostatically charging a cylindrical electrophotographic photosensitive member to impart electric charges thereto; said electrophotographic photosensitive member comprising a conductive support and a photosensitive layer provided thereon, wherein said photosensitive layer contains oxytitanium phthalocyanine as a charge-generating material and a charge-transporting material, and the charge-generating material and the charge-transporting material have a work function ($W_F^{CG}$) and a work function ($W_F^{CT}$), respectively, that satisfy the expression:

$$-0.2 < W_F^{CG} - W_F^{CT} \leqq 0 \ (eV);$$

subjecting the electrophotographic photosensitive member to image exposure to form thereon an electrostatic latent image;

developing the electrostatic latent image to form a visible image; and transferring the visible image to a transfer member;

said steps of electrostatic charging, image exposure, developing and transfer being carried out while said electrophotographic photosensitive member rotates once, and the time taken for said electrophotographic photosensitive member to rotate once being 1.5 seconds or less.

2. An image forming method according to claim 1, wherein said oxytitanium phthalocyanine has a crystal form having strong peaks at diffraction angles of $2\theta \pm 0.2°$ of 9.0°, 14.2°, 23.9° and 27.1° as measured by CuKα characteristic X-ray diffraction.

3. An image forming method according to claim 1, wherein said $W_F^{CG}$ and $W_F^{CT}$ satisfy the expression:

$$-0.2 < W_F^{CG} - W_F^{CT} \leqq 0 \ (eV).$$

4. An image forming method according to claim 1, wherein said photosensitive layer comprises a charge generation layer containing a charge-generating material and a charge transport layer containing a charge-transporting material.

* * * * *

UNITED STATES PATENT AND TRADEMARK OFFICE

CERTIFICATE OF CORRECTION

PATENT NO. : 5,384,625

DATED : January 24, 1995

INVENTOR(S) : HIDEKI ANAYAMA, ET AL.

It is certified that error appears in the above-identified patent and that said Letters Patent is hereby corrected as shown below:

ON TITLE PAGE

In [57] ABSTRACT:

Line 14, "satisfies" should read --satisfy--.
Line 17, "is" should read --are--.

COLUMN 4

Line 8, "form" should read --forms--.
Line 10, "form" should read --form from--.

COLUMN 8

Line 58, "from" should read --form--.

COLUMN 11

Line 49, "of;" should read --of:--.

COLUMN 12

TABLE 1, "uneveness" should read --unevenness-- and
"Uneveness" should read --unevenness--.

UNITED STATES PATENT AND TRADEMARK OFFICE

CERTIFICATE OF CORRECTION

PATENT NO. : 5,384,625

DATED : January 24, 1995

INVENTOR(S) : HIDEKI ANAYAMA, ET AL.

It is certified that error appears in the above-identified patent and that said Letters Patent is hereby corrected as shown below:

COLUMN 12

Line 51, "$-0.2<W_F^{CG}-W_F^{CT}\leqq 0$(eV)." should read -- $-0.1<W_F^{CG}-W_F^{CT}\leqq 0$(eV).--.

Signed and Sealed this

Ninth Day of May, 1995

Bruce Lehman

*Attest:*

BRUCE LEHMAN

*Attesting Officer*

*Commissioner of Patents and Trademarks*